US005916255A

United States Patent [19]

Izumi et al.

[11] Patent Number: 5,916,255

[45] Date of Patent: Jun. 29, 1999

[54] OUTDOOR UNIT OF A SEPARATE TYPE AIR CONDITIONER

[75] Inventors: Yoshiki Izumi, Kyoto; Katsuhiko Fujiwara, Kusatsu; Kiyoshi Sano, Otsu; Takashi Sugio, Kusatsu, all of Japan

[73] Assignee: Matsushita Electric Industrial Co., Ltd., Kadoma, Japan

[21] Appl. No.: 09/071,866

[22] Filed: May 5, 1998

[30] Foreign Application Priority Data

May 12, 1997 [JP] Japan ..... 9-120626

[51] Int. Cl.[6] ..... F25D 17/04; F24D 5/10

[52] U.S. Cl. ..... 62/404; 62/262; 165/53; 165/122

[58] Field of Search ..... 165/122, 124, 165/53; 62/428, 262, 404

[56] References Cited

U.S. PATENT DOCUMENTS 4,505,129 3/1985 Yamane ..... 62/507

FOREIGN PATENT DOCUMENTS 621858 12/1959 Italy .
55-79945 12/1978 Japan .
58-205029 5/1982 Japan .
62-100425 6/1987 Japan .
3-213928 9/1991 Japan .
5-164362 6/1993 Japan .
5-215367 8/1993 Japan .

*Primary Examiner*—Henry Bennett
*Assistant Examiner*—Melvin Jones
*Attorney, Agent, or Firm*—Wenderoth, Lind & Ponack, L.L.P.

[57] ABSTRACT

An outdoor unit of a separate type air conditioner has suction ports and a blow-out port which can be disposed freely on the same side of the unit. Also, an outdoor unit of a one-side suction and exhaust type is excellent in static pressure characteristic, sufficient in air flow rate using only one blower, and is easy to install. Suction ports (8) are disposed at both sides in the front side of an outdoor unit main body (outer case 7), and a blow-out port (6*a*) is disposed in the center of the front side. A heat exchanger (3), an orifice (5), and one centripetal fan (1) are sequentially disposed behind the blow-out port (6*a*), thereby forming a draft circuit for sucking air from the suction ports (8) at the outer circumference of blades (1*a*) of the centripetal fan (1). The air is blown out ahead of the blades (1*a*) through the orifice (5) and heat exchanger (3). Therefore, since suction space is not required, the outdoor unit can be installed close to a wall. In addition, by the use of the centripetal fan (1), a sufficient air flow rate is obtained with only one blower, and the size of the outdoor unit for producing a same capacity may be kept to a minimum.

6 Claims, 3 Drawing Sheets

OUTDOOR UNIT OF A SEPARATE TYPE AIR CONDITIONER

BACKGROUND OF THE INVENTION

1. Field of the Invention

The present invention relates to an outdoor unit of a separate type air conditioner having a heat pump for air cooling and heating.

2. Description of the Related Art

In an outdoor unit of a conventional separate type air conditioner, generally, as shown in FIGS. 3(*a*), (*b*), (*c*), a draft circuit was composed by disposing a U-shaped heat exchanger 22, a motor 23, an outdoor fan 20 enclosed by an orifice 21, and a front grill 27 sequentially from the upstream side of the air flow. A electric control unit 25 and a compressor 26 are disposed in the upper part or lower part of the unit relative to the outdoor fan 20, respectively. Also, a fan motor 23 was fixed on a motor support stand 24.

Other constructions are also proposed in, for example, Japanese Laid-open Patent No. 5-215367, Japanese Laid-open Patent No. 3-213928 and Japanese Laid-open Utility Model No. 62-100425.

That is, in Japanese Laid-open Patent No. 5-215367, an outdoor unit for intake and exhaust at one side using a lateral flow fan is disclosed, in which a blow-out port is provided in the upper part, a suction port in the lower part, and a heat exchanger, lateral flow fan and blow-out port are sequentially disposed at the downstream side of the suction port for forming a draft circuit.

In Japanese Laid-open Patent No. 3-213928, the air suction port and blow-out port are provided in upper and lower positions on a same side, and the heat exchanger and blower are distributed in the upper and lower parts in the outdoor unit main body. In Japanese Laid-open Utility Model No. 62-100425, a unit is designed to suck and exhaust on one side by using two sirocco fans incorporated in the scroll casing of the outdoor unit.

In the conventional constructions of the outdoor unit of separate type air conditioners, however, the air is sent, as shown by the arrow in FIG. 3*a*, by crossing longitudinally the outdoor unit in the sequence of the heat exchanger 22, outdoor fan 20 and front grill 27, not sucking or exhausting on one side only, and it hence requires a suction space and a blow-out space, and the outdoor unit cannot be installed close to a wall of a building, and considerable space is needed for installation. Therefore, in apartment buildings or the like, the outdoor unit cannot be installed in a corridor or the like, and the installation of the outdoor unit is limited by the particular conditions.

Accordingly, one-side suction and exhaust types were proposed as disclosed in Japanese Laid-open Patent No. 5-215367, Japanese Laid-open Patent No. 3-213928 and Japanese Laid-open Utility Model No. 62-100425. However, in Japanese Laid-open Patent No. 5-215367, the optimum configuration of the heat exchanger and lateral flow fan is definitely determined, and, in spite of one-side suction and exhaust, the positions of the blow-out port and suction port are definitely fixed, and the blow-out port comes to the upper part and the suction port to the lower part, and there is no freedom with respect to the layout of the unit. The lateral flow fan itself is weak in static pressure characteristic, and is likely to cause surging by a slight load change, and there are many problems in performance experienced with the outdoor unit which is exposed to frost deposit.

In Japanese Laid-open Patent No. 3-213928, since the heat exchanger and blower are distributed in the upper and lower parts of the outdoor unit main body, the size of the outdoor unit for producing the same capacity tends to be larger.

In Japanese Laid-open Utility Model No. 62-100425, since the sirocco fan is used as the blower, the sirocco fan which is a centrifugal blower, requires a scroll casing, and thus the number of parts is increased and the cost becomes higher. Besides, if one sirocco fan is used, the air flow is small for the draft performance, in order to maintain the necessary air flow as the outdoor unit of air conditioner, at least two are needed, which also increases costs.

SUMMARY OF THE INVENTION

The invention is hence designed to solve the above problems, and it is an object thereof to provide an outdoor unit of a separate type air conditioner having freedom in the locations of the suction ports and the blow-out port, excellent static pressure characteristics, sufficient air flow with only one blower, and easy installation due to the one-sided suction and exhaust.

To achieve the above objects, the outdoor unit of a separate unit air conditioner of the present invention is characterized by suction ports disposed in at least two opposite sides or two adjacent sides, and a draft circuit formed by disposing the suction ports, a centripetal fan, and orifice surrounding the centripetal fan, a heat exchanger and a front grill sequentially from the upstream side of the air flow in a box shaped outdoor unit main body having a blow-out port in a central portion of a same side as the suction ports. Therefore, while the centripetal fan is rotating, air is sucked in from suction ports in at least two opposite sides or two adjacent sides, and the air is blown out sequentially to the leeward side from the blow-out port having the front grill disposed in the same side as the centripetal fan, orifice, heat exchanger and suction ports. The outdoor unit can be installed close to a wall, so that the outdoor unit can be installed freely in the corridor of an apartment building or the like. Also, by using the centripetal fan behind the heat exchanger, sufficient air flow performance is obtained by one blower, and a compact and inexpensive outdoor unit can be formed.

That is, the present invention is characterized by disposing suction ports in at least two opposite sides or two adjacent sides, and forming a draft circuit by disposing the suction ports, a centripetal fan, an orifice surrounding the centripetal fan, a heat exchanger and a front grill sequentially from the upstream side of air flow in a box shaped outdoor unit main body having a blow-out port in the central portion of the same side as the suction ports.

The invention is also characterized by disposing the suction ports at both sides in the front surface of an outdoor unit main body, and the blow-port in the central part of the front surface, and also disposing the centripetal fan, so that the air sucked in from the periphery of the blades of the centripetal fan through the suction ports is blown out ahead of the blades through the orifice and the heat exchanger.

The outdoor unit includes an electric control unit and a compressor which are disposed in positions so that they do not disturb the air flow.

Also, in the outdoor unit, an electric control unit is disposed in the upper part of the centripetal fan and a compressor in the lower part of the unit.

Also, in the outdoor unit, a plurality of stationary vanes are disposed radially so as to surround the outer circumference of windward side of the centripetal fan.

In the construction of the invention, therefore, since the suction and exhaust ports of the draft circuit of suction and blow-out are disposed on a same side of the outdoor unit main body, that is, in a specific configuration, the suction ports are disposed at both sides in the front surface of the outdoor unit main body, and the blow-port in the central part of the front surface, suction space, which is required in the prior art, is not necessary, and the outdoor unit can be installed close to the wall of a building, so that space may be saved.

In particular, by using the centripetal fan, the centripetal fan itself has the static pressure characteristic for producing a sufficient air flow by resisting the load applied to the air conditioner, and the noise level is low. Therefore, performance may be enhanced from the conventional lateral flow fan, and together with the orifice, by using only one centripetal fan, the required air flow as the outdoor unit of air conditioner is obtained, and the number of necessary blowers and the number of parts are small, and the cost is lower. Moreover, if the centripetal fan is installed behind the heat exchanger, one-side suction and exhaust can be realized, and the space efficiency is superior, so that the size of the outdoor unit producing the same capacity can be at a minimum limit.

Still more, by laying out the parts so as not to disturb the draft circuit, for example, by disposing the electric control unit in the upper part of the centripetal fan and the compressor in the lower part of the centripetal fan, the blowing characteristic of the centripetal fan is not disturbed, and a sufficient air flow characteristic can be obtained at low noise, and the electric control unit and compressor can be accommodated most rationally, and the size of the outdoor unit may be kept to a minimum.

Further, by disposing a plurality of stationary vanes radially so as to surround the outer circumference of the windward side of the centripetal fan, in an air heating operation of the air conditioner, if frost deposit is promoted on the heat exchanger of the outdoor unit and the load on the centripetal fan is increased, the static pressure characteristic of the centripetal fan is increased by the action of the stationary vanes. Accordingly, against the load of the outdoor unit, a sufficient air flow is provided, and a high air heating capacity is obtained.

DETAILED DESCRIPTION OF THE INVENTION

Figure 1A:
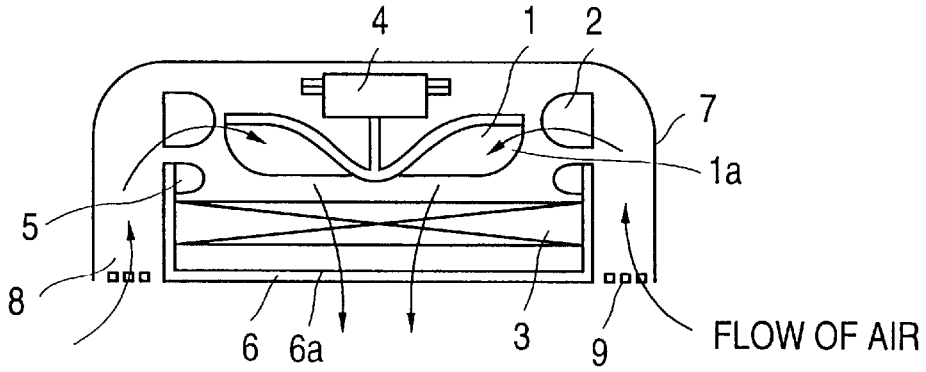
FIG. 1(*a*) is a top sectional view of an outdoor unit of a separate type air conditioner in first and second embodiments of the invention, FIG. 1(*b*) is a front sectional view of the same outdoor unit, and FIG. 1(*c*) is a side sectional view of the same outdoor unit.

Referring now to the drawings, embodiments of the present invention are described in detail below.

Figure 1B:
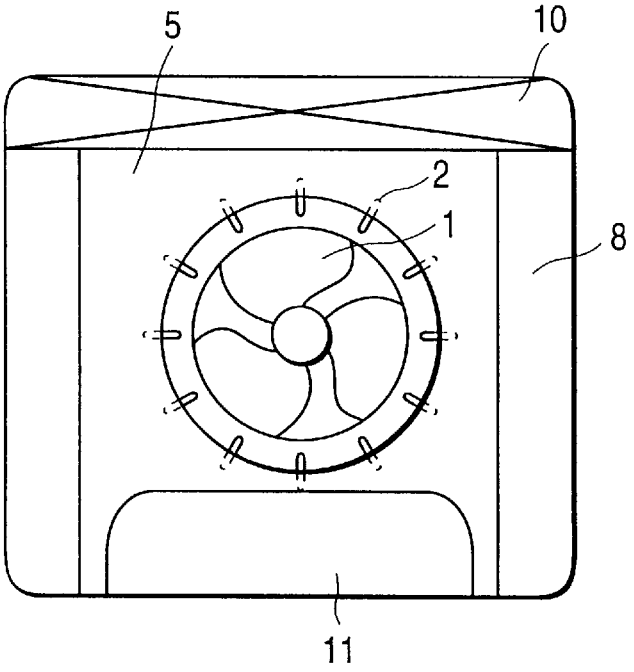
Figure 1C:
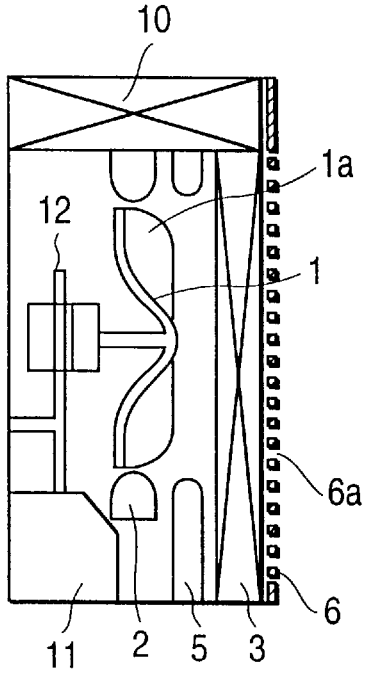

A first embodiment of the invention is described below by referring to FIGS. 1(*a*), (*b*), (*c*). FIG. 1(*a*) is a sectional view of an outdoor unit of a separate type air conditioner as seen from the top, FIG. 1(*b*) is a sectional view of the same outdoor unit as seen from the front, and FIG. 1(*c*) is a sectional view of the same outdoor unit as seen from a side.

In the drawing figures, an outer case 7 which is an outdoor unit main body has suction ports 8 provided with suction grills 9 at two confronting sides, that is, both sides in the front side of the outer case 7, and has a blow-out port 6*a* provided with a front grill 6 in the central part of the front side. Sequentially from the upstream side of the air flow inside the outdoor unit main body, the suction ports 8, a centripetal fan 1 having a plurality of blades 1*a* disposed in the center in the outdoor unit main body, an orifice 5 surrounding the centripetal fan 1, a type I heat exchanger 3 at the forward side of the centripetal fan 1 in the front part (leeward side) of the orifice 5, and the blow-out port 6*a* having the front grill 6 at the front part of the heat exchanger 3 are disposed. A motor 4, for driving the centripetal fan 1, is supported on a motor support stand 12 at the back side.

In this construction, when the motor 4 runs and the centripetal fan 1 rotates, air is sucked in from the outer circumference of the blades 1*a* of the centripetal fan 1 through the suction ports 8 at both sides of the front side of the outer case 7, and is blown out forward from the central part of the case. Therefore, one-side suction and exhaust is realized, and suction spaced is not required behind the case as is needed in the prior art unit, and therefore the outdoor unit can be installed close to the wall of a building, and space is saved. Therefore, in an apartment building or the like, the outdoor unit can be freely installed in the corridor close to the wall of the building.

In the construction of one-side suction and exhaust, if a conventional lateral flow fan is used, the static pressure characteristic of the lateral flow fan is weak, and surging may be caused by only a slight load change, and if used as an outdoor unit exposed to frost deposit, the air heating and cooling performance may be lowered and thus there are many problems as an air conditioner.

On the other hand, the centripetal fan 1 of the present invention has a static pressure capable of producing a sufficient air flow rate, resisting the load applied to the air conditioner, and the noise level is also low. And, therefore the centripetal fan is superior to the lateral flow fan from the viewpoint of performance.

Incidentally, if a conventional axial flow blower is used, to realize one-side suction and exhaust, the heat exchanger and blower must be installed separately in the upper and lower parts in the outdoor unit main body, and thus the size of the outdoor unit is necessarily increased in order to produce the same capacity.

By contrast, in the present invention using the centripetal fan 1, if installed behind the heat exchanger 3, one-side suction and exhaust is realized, the space efficiency is excellent, and the size of the outdoor unit for producing the same capacity can be kept to a minimum.

In the conventional construction of one-side suction and exhaust by sirocco fans, a scroll casing is needed, and two sirocco fans are necessary to produce the required air flow for the outdoor unit of the air conditioner, which results in higher costs.

In the construction of the present invention using the centripetal fan 1, by installing only one centripetal fan 1 having a plurality of blades 1*a* surrounded by the orifice 5 behind the heat exchanger 3, the necessary air flow for one-side suction and exhaust is realized, the space efficiency is excellent, the size of the outdoor unit producing a same capacity can be minimized, and the number of parts and the cost is lower.

A second embodiment of the present invention is described by referring to FIGS. 1(*b*) and (*c*).

As shown in the diagram, an electric part (an electric unit) 10 and a compressor 11 are disposed at positions so as to not disturb the air flow (not draft circuit parts). That is, in the embodiment, the electric control part 10 is disposed above the centripetal fan 1, and the compressor 11 is disposed below the centripetal fan 1.

In this construction, when the centripetal fan 1 rotates and produces an air flow, since the electric part 10 and the compressor 11 do not disturb the draft action, the draft performance of the centripetal fan 1 is not impeded, and low noise and a sufficiently large air flow characteristic are realized. Also, by disposing the electric part 10 and compressor 11 above and below the centripetal fan 1, respectively, they can be accommodated in the outer case 7 most rationally, and the size of the outdoor unit can be minimized.

Figure 2A:
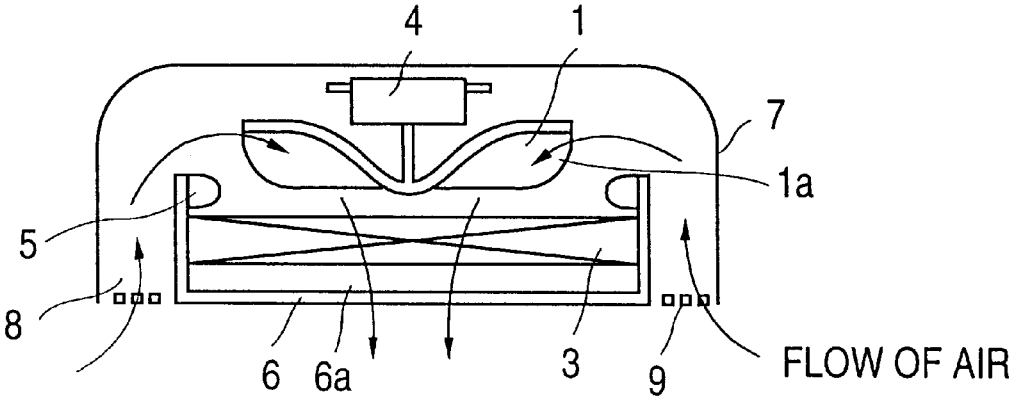
FIG. 2(*a*) is a top sectional view of an outdoor unit of a separate type air conditioner in a third embodiment, FIG. 2(*b*) is a front sectional view of the same outdoor unit, and FIG. 2(*c*) is a side sectional view of the same outdoor unit.
Figure 2B:
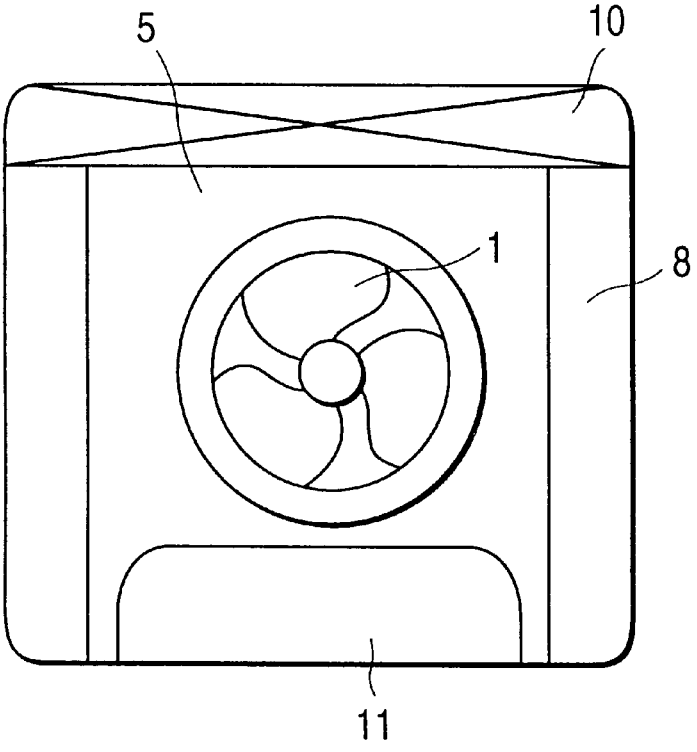
Figure 2C:
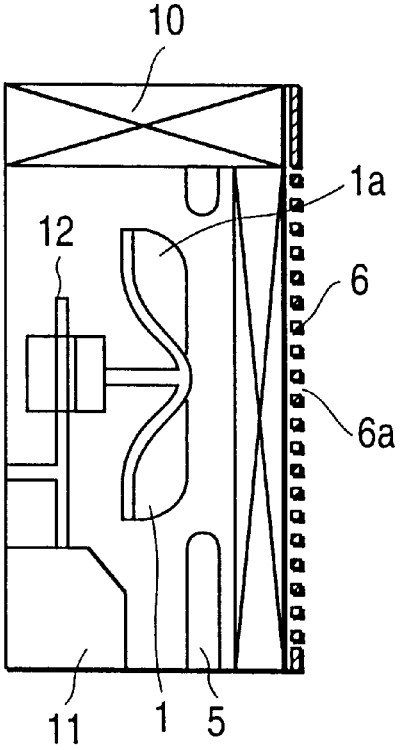
Figure 3A:
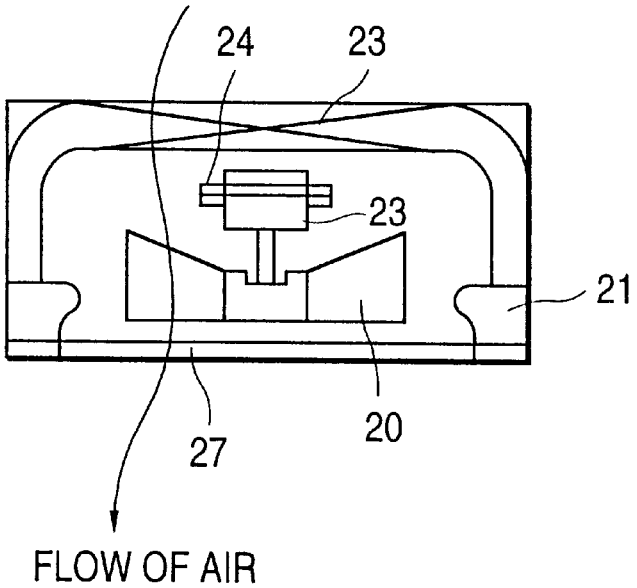
FIG. 3(a) PRIOR ART
FIG. 3(*a*) is a top sectional view of a conventional outdoor unit of a separate type air conditioner, FIG. 3(*b*) is a front sectional view of the same outdoor unit, and FIG. 3(*c*) is a side sectional view of the same outdoor unit.
Figure 3B:
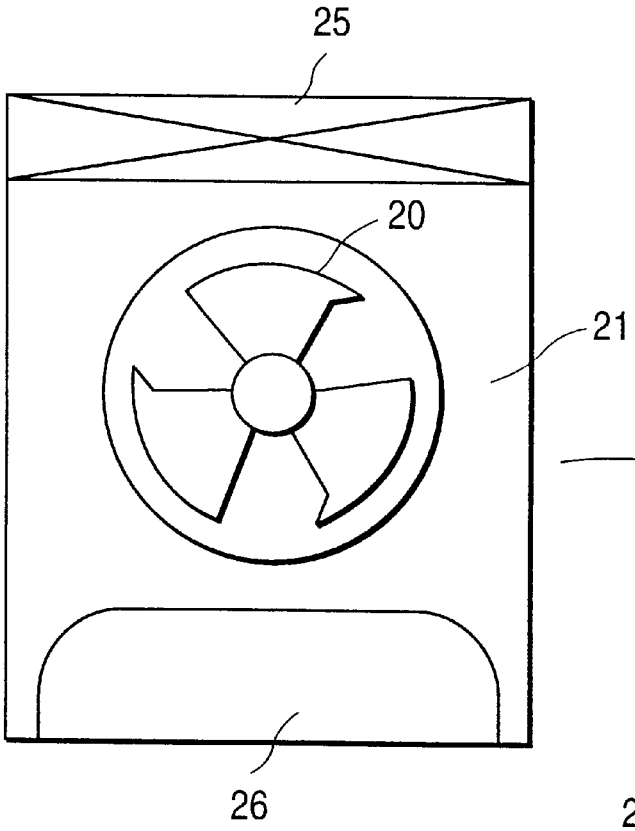
FIG. 3(b) PRIOR ART
Figure 3C:
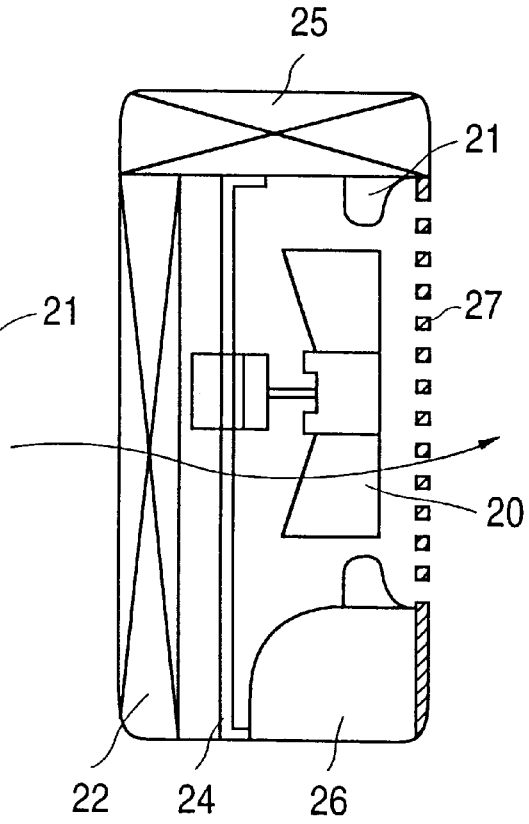
FIG. 3(c) PRIOR ART

A third embodiment of the invention is described by referring to FIG. 2(*a*), (*b*) and (*c*).

As shown in the drawing, the draft circuit is formed by disposing a plurality of radial stationary vanes 2 so as to surround the centripetal fan 1 along the outer circumference of the windward side of the centripetal fan 1.

The air conditioner, in air heating operation, frost deposit on the heat exchanger 3 of the outdoor unit is promoted and the load applied to the centripetal fan 1 is increased. In this case, having such a construction, since the static pressure of the centripetal fan 1 is increased by the action of the stationery vane 2, sufficient air flow can be produced for the load of the outdoor unit, so that a high air heating capacity can be obtained.

As is clear from the description of the embodiments, suction ports are disposed in at least two confronting sides or two adjacent sides, and a blow-out port is disposed in the central part of the same side as the suction ports. That is, in a specific configuration, inside of the box shaped outdoor unit main body unit disposing suction ports at both sides of the front side and a blow-out port in the central part of the front side, the suction ports, one centripetal fan, an orifice surrounding the centripetal fan, a heat exchanger and a front grill are disposed sequentially from the upstream side of the air flow, thereby forming a draft circuit.

In this construction, one-side suction and exhaust is realized, and, as a result, suction space is not necessary, and the outdoor unit can be installed close to the wall of a building, and thus space is saved. In an apartment building or the like, therefore, the outdoor unit can be installed freely in the corridor, close to the wall of the building.

In particular, the centripetal fan has a static pressure characteristic capable of producing a sufficient air flow by resisting the load applied to the air compressor, and the noise level is also low, and therefore the performance may be enhanced from the conventional lateral flow fan. Also, by using only one centripetal fan together with the orifice, a necessary air flow as the outdoor unit of air conditioner is obtained. Hence, the number of required blowers and the number of parts are decreased, and the cost is reduced. Moreover, if the centripetal fan is provided behind the heat exchanger, one-side suction and exhaust is possible, and the space efficiency is excellent, and the size of the outdoor unit producing the same capacity can be minimized.

Also, the electric part and compressor are disposed in positions so as to not disturb the flow of air, that is, in the upper and lower parts of the centripetal fan, and therefore the blowing characteristic of the centripetal fan is not disturbed, and low noise and sufficient air flow characteristics are obtained, while the electric part and compressor can be accommodated most rationally, and the size of the outdoor unit may be minimized.

Also, a plurality of radial stationary vanes are disposed so as to surround the outer circumference of the windward side of the centripetal fan, and therefore, in an air heating operation of the air conditioner, if frost deposit on the heat exchanger of the outdoor unit is promoted and the load applied on the centripetal fan increases, the static pressure characteristic of the centripetal fan is increased by the action of the stationary vanes. As a result, against the load of the outdoor unit, a sufficient air flow is presented, and a high air heating capacity is obtained.

What is claimed is:

1. An outdoor separate type air conditioning unit comprising:

a box-shaped outdoor unit main body;

a plurality of suction ports provided in a first side of said main body;

a centripetal fan disposed in said main body;

a plurality of stationary vanes disposed radially about an outer circumference of said centripetal fan;

a structure forming an orifice which surrounds said centripetal fan;

a heat exchanger disposed in said main body in front of said centripetal fan; and a front grill positioned in said first side of said main body and forming a blow-out port in a central portion of said first side of said main body, wherein a draft circuit is formed in said main body by sequentially positioning said suction ports, said centripetal fan, said orifice, and said front grill from an upstream side of air flow through said main body.

2. An outdoor separate type air conditioning unit as claimed in claim 1, further comprising an electric control unit and a compressor, wherein said electric control unit and said compressor are disposed in said main body so as to not disturb the air flow through said main body.

3. An outdoor separate type air conditioning unit as claimed in claim 1, further comprising:

an electric control unit disposed in said main body above said centripetal fan; and a compressor disposed in said main body below said centripetal fan.

4. An outdoor separate type air conditioning unit comprising:

an outdoor unit main body having a front surface;

a plurality of suction ports provided in opposite sides of said front surface of said main body;

a blow-out port formed in a central part of said front surface of said main body;

a single centripetal fan disposed in said main body and having a plurality of blades;

a plurality of stationary vanes disposed radially about an outer circumference of said centripetal fan;

a structure forming an orifice which surrounds said centripetal fan; and a heat exchanger disposed in said main body, wherein said heat exchanger, said orifice and said centripetal fan are disposed sequentially behind said blow-out port thereby forming a draft circuit for sucking air in through said suction ports and blowing air out from said blades through said orifice and said heat exchanger.

5. An outdoor separate type air conditioning unit as claimed in claim 4, further comprising an electric control unit and a compressor, wherein said electric control unit and said compressor are disposed in said main body so as not to disturb air flow through said main body.

6. An outdoor separate type air conditioning unit as claimed in claim 4, further comprising:

an electric control unit disposed in said main body above said centripetal fan; and a compressor disposed in said main body below said centripetal fan.

* * * * *